US007337744B2

(12) United States Patent
Marcellus

(10) Patent No.: US 7,337,744 B2
(45) Date of Patent: Mar. 4, 2008

(54) BOAT SAFETY FLOAT

(75) Inventor: Saint-Ange Marcellus, 38 Nelson Dr., Randolph, MA (US) 02368

(73) Assignee: Saint-Ange Marcellus, Randolph, MA (US)

( * ) Notice: Subject to any disclaimer, the term of this patent is extended or adjusted under 35 U.S.C. 154(b) by 0 days.

(21) Appl. No.: 11/362,626

(22) Filed: Feb. 25, 2006

(65) Prior Publication Data

US 2006/0191465 A1 Aug. 31, 2006

Related U.S. Application Data

(60) Provisional application No. 60/656,800, filed on Feb. 27, 2005.

(51) Int. Cl.
*B63B 43/02* (2006.01)

(52) U.S. Cl. ..... 114/360; 114/68

(58) Field of Classification Search ..... 114/68, 114/69, 360
See application file for complete search history.

(56) References Cited

U.S. PATENT DOCUMENTS

| | | | | |
|---|---|---|---|---|
| 1,118,420 | A * | 11/1914 | Horst | 441/101 |
| 1,133,629 | A * | 9/1915 | Foster | 114/68 |
| 3,822,662 | A * | 7/1974 | Morita et al. | 114/123 |
| 4,867,094 | A * | 9/1989 | Binks | 114/359 |
| 4,996,936 | A * | 3/1991 | Brundritt | 114/68 |
| 6,484,656 | B2 * | 11/2002 | Mears et al. | 114/68 |

* cited by examiner

*Primary Examiner*—Sherman Basinger

(57) ABSTRACT

An aquatic vessel safety device, comprised of a set of automatically inflatable water-tight inflatable flotation bladders, attached to the hull of any aquatic vessel or boat capable of being quickly inflated when the aquatic vessel is in danger of being sunk or capsized.

1 Claim, 2 Drawing Sheets

Replacement Sheet
D
E
F
G1
G2
C
T
O2
Gas
Cl
B
C
A
H2
H1
18
16
20
9
21
8
12
22
3
11
10
17
6
12
7
19a
19b
13
14
15
16

BOAT SAFETY FLOAT

CROSS-REFERENCE TO RELATED APPLICATIONS

Priority is claimed under 35 USC §119(e) to the provisional patent application 60/656,800 filed on Feb. 27, 2005.

BACKGROUND OF INVENTION

This invention relates to a safety device for pleasure boats or other aquatic vessels. Every year aquatic vessels sink killing or injuring a great number of innocent people, causing property loses and physical and psychological injuries. Countless lives, property and money can be saved by technically addressing the issue of unexpected and sudden sinking of an aquatic vessel through the use of a specially designed emergency flotation device. This device would allow an aquatic vessel to remain floating on the surface in case of any unexpected sinking or capsizing event.

SUMMARY OF INVENTION

The Boat Safety Float is a device that will prevent aquatic vessels from sinking if it should become incapable of displacing sufficient water to float on its own accord. This device, when deployed, provides a "raft" like float along each side of the vessel and provides supplemental flotation adequate to sustain the vessel on the surface of the water. The Boat Safety Float is deployed using compressed gas, a gas compressor, or a chemical gas generator, which are activated by an emergency safety valve similar in design to a traditional fire extinguisher.

The Boat Safety Float is comprised of water-tight inflatable flotation bladders that are packaged in specially designed low-profile compartments. These bladder storage compartments are mounted along the sides of the vessel's hull near its top deck. The bladder storage compartments are generally clear of the aquatic vessel's normal water line and thus do not interfere with the aquatic vessel's hydro-dynamic hull design. Similar to air bags in automobiles, each water-tight inflatable flotation bladder is then tightly folded and packaged into the bladder storage compartments and sealed from the environment until inflated.

When the Boat Safety Float water-tight inflatable flotation bladders are inflated they expand out of the bladder storage compartments along the hull and form two large round floats on along each side of the aquatic vessel. The water-tight inflatable flotation bladders are permanently attached to the aquatic vessel's hull at numerous locations using heavy duty stainless steel bolts and backing plates on the inside of the aquatic vessel's hull.

DESCRIPTION OF THE INVENTION

Figure 1:
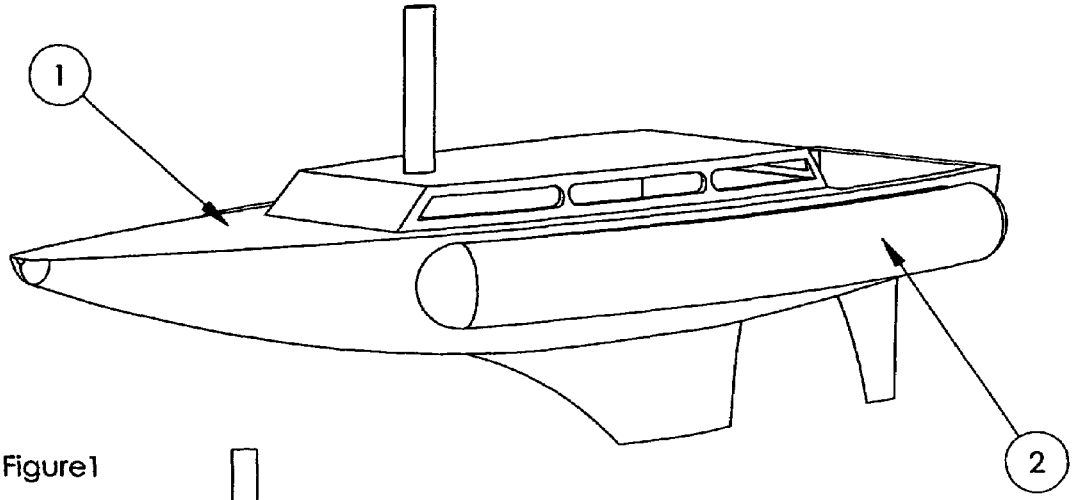
FIG. 1 depicts the Boat Safety Float with its water-tight inflatable flotation bladders fully deployed on an aquatic vessel in its entirety from a port sided, three dimensional, isometric view.

The terminology used herein should be interpreted in its broadest reasonable manner, even though it is being utilized in conjunction with a detailed description of a certain specific preferred embodiment of the present invention. This is further emphasized below with respect to some particular terms used herein. Any terminology that the reader should interpret in any restricted manner will be overtly and specifically defined as such in this specification. The preferred embodiment of the present invention will now be described with reference to the accompanying drawings, wherein like reference characters designate like or similar parts throughout.

As stated in the Summary of Invention, the Boat Safety Float is a device made from several inter-working components that provide a method to keep an aquatic vessel floating on the surface when its hull has been flooded and is no longer able to displace sufficient water to float on its own. The Boat Safety Float can be scaled to produce adequate water displacement to maintain almost any size aquatic vessel on the surface until rescue can be accomplished. It is also envisioned that in some cases the vessel can be pumped dry while maintained on the surface by the Boat Safety Float and subsequently return to shore, or to a safe haven, under its own power.

Figure 2:
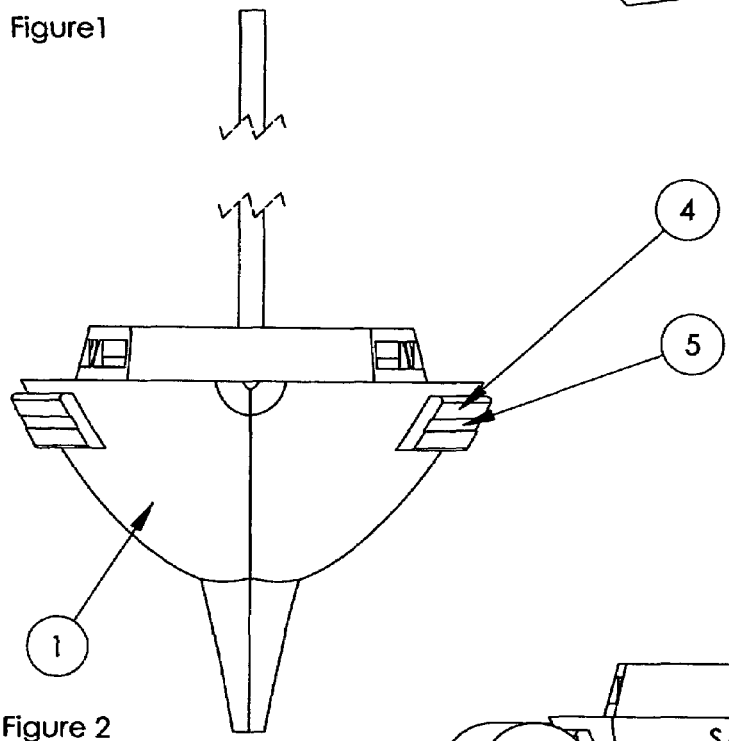
FIG. 2 depicts the Boat Safety Float water-tight inflatable flotation bladders from a stem view as they are stored in its bladder storage compartments alongside the hull of an aquatic vessel.
Figure 3:
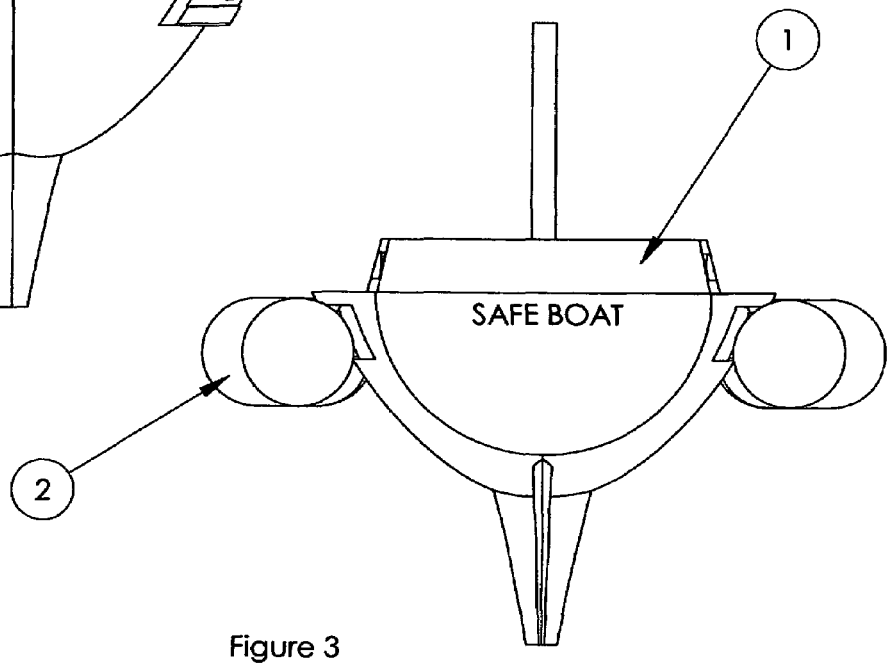
FIG. 3 depicts the Boat Safety Float water-tight inflatable flotation bladders from a stem view as they are fully deployed along the sides of the hull of an aquatic vessel.

The Boat Safety Float is comprised of three major assemblies. The first, and perhaps the most important, are the two water-tight inflatable flotation bladders which are made of a high strength ballistic rubber material, or some other such suitable material, which would be scaled according to well known in the art water displacement calculations for the particular vessel 1 as depicted in FIG. 1. With reference to FIGS. 2 & 3, the second components to the Boat Safety Float are the two bladder storage compartments 4. The bladder storage compartments 4 have a bladder release slot 5 laterally along its length as shown in FIG. 2. The purpose of the slot 5 is to allow a break-away point in the bladder storage compartment 4 so that the water-tight inflatable flotation bladders 2 can be deployed when needed. These bladder storage compartments 4 are mounted along the sides of the vessel's 1 hull near its top deck. The bladder storage compartments 4 are generally clear of the aquatic vessel's 1 normal water line and thus do not interfere with the aquatic vessel's 1 hydro-dynamic hull design. The third component is compressed gas with emergency inflation valve 14 of FIG. 6. Each component will be discussed in turn.

Figures 4, 5, 6:
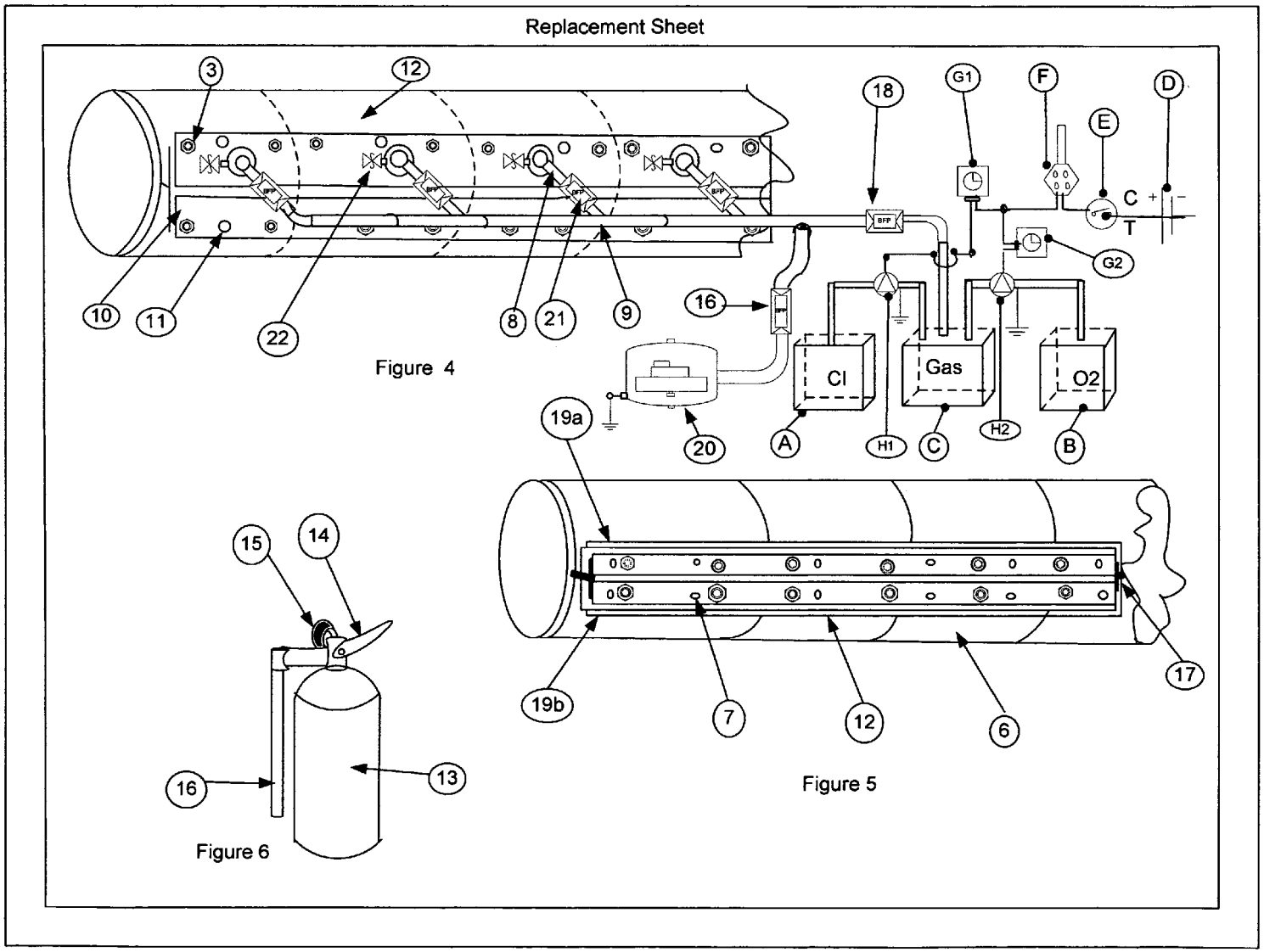
FIG. 4 depicts a cut-away view of a fully deployed Boat Safety Float water-tight inflatable flotation bladder.
FIG. 5 depicts a fully deployed Boat Safety Float water-tight inflatable flotation bladder from the outside and shows how it attaches to the bladder storage compartment and hence the vessel.
FIG. 6 depicts the gas storage device along with the emergency inflation valve and plumbing.

It is envisioned that the Boat Safety Float water-tight inflatable flotation bladders 2 are comprised of air tight heavy duty ballistic materials that are thermo bonded and welded at each seam. The water-tight inflatable flotation bladders 2 are designed with multiple inflatable cells 12 separated by cell separators 6 as depicted in the cut-away view shown in FIG. 4. Each of the water-tight inflatable flotation bladders 2 and the inflatable cells 12 are plumbed to a pressurized cylinder 13 and thus to an emergency valve 14 through individual inflation fittings 7 via air hoses 8 as shown in FIG. 5 and combined bladder inflation hoses 9 as shown in FIG. 5 that join each of the inflatable cells 12 through check valves to isolate each inflatable cell's 12 pressure from all other inflatable cells 12 during inflation. The inflatable cells 12 are provided to ensure that the water-tight inflatable flotation bladders 2 will still maintain the vessel's 1 displacement, even if one of the inflatable cells 12 is punctured while inflated. Each individual inflatable cell 12 has a removable pressure relief plug 3 to release any gas once the need for inflation is over. Each water-tight inflatable flotation bladder 2 is also comprised of a fabric mounting strip 10 made of the same material as the bladders 2 that are sewn into and parallel to the sides of the water-tight inflatable flotation bladders as depicted in FIG. 5. With continued reference to FIG. 5, the mounting strips 10 are also comprised of mounting holes with brass reinforcement grommets 11 used to affix the floatation bladders to the vessel's 1 hull. The water-tight inflatable flotation bladders 2 are securely bolted and mounted to the vessel's 1 hull through the back of each bladder storage compartments 4 using stainless steel or brass bolts threaded through bladder bolt holes 11 at multiple evenly spaced points through mounting holes along the vessel's 1 hull. Thus, the water-tight inflatable flotation bladders 2 are permanently attached to the aquatic vessel's 1 hull at numerous locations by traditional backing plates on the inside of the aquatic vessel's 1 hull. When the Boat Safety Float water-tight inflatable flotation bladders 2 are inflated they expand out of the compartments along the hull and form two large round floats on each side of the aquatic vessel 1.

With continued reference to FIG. 2, it is further envisioned that the Boat Safety Float bladder storage compartments 4 are comprised of fiberglass, plastic, aluminum or other suitable and durable waterproof materials. The bladder storage compartments 4 are an elongated rectangular and horizontal box that is designed with a rubber sealed bladder release slot 5 at its face and alongside its side and length. Each bladder storage compartment 4 with tightly packed water-tight inflatable flotation bladders 2 are mounted along each side of the vessel's 1 hull using stainless steel or brass screws and bolts and are sealed in the traditional ways to be watertight. The bladder storage compartments 4 provide a tightly packed enclosure that serves to protect and hold the water-tight inflatable flotation bladders 2 in a very low profile along each side of the vessel 1 until needed in an emergency situation. Similar to air bags in automobiles, each water-tight inflatable flotation bladder 2 is tightly folded and packaged into the bladder storage compartments 4 and sealed and stored from the environment until inflated.

The Boat Safety Float water-tight inflatable flotation bladders 2 are quickly inflated using compressed air stored in pressurized cylinder 13. It if further envisioned, though not drawn, that a specially designed gas generator based on a chemical reaction which produces large volumes of gas instantaneously when activated by a catalytic component could also be used. In either case, the gas is activated or released into the water-tight inflatable flotation bladders 2 using an emergency inflation valve 14 as depicted in FIG. 6, which may be attached to a safety cord or handle mounted in a place easily reached by the aquatic vessel's occupants. The gas, once activated, travels from the pressurized cylinder 13, through the emergency inflation valve 14 and through the pressure line 16. Said pressure line 16 is inline and affixed with the bladder inflation hose 9 depicted in FIG. 4. A manual shut off valve 15 is deployed on the pressurized cylinder 13 in case it is desirous to shut off the compressed gas before the water-tight inflatable flotation bladders 2 are fully inflated.

The foregoing description details certain preferred embodiments of the present invention and describes the best mode contemplated. It will be appreciated, however, that no matter how detailed the foregoing description appears, the invention can be practiced in many ways without departing from the spirit of the invention. Therefore, the description contained in this specification is to be considered exemplary, rather than limiting, and the true scope of the invention is only limited by the following claims and any equivalents thereof.

What is claimed is:

1. A boat safety float system comprising:

A boat, said boat having a hull;

At least one watertight inflatable flotation bladder, said at least one bladder being made from air tight heavy duty balistic materials that are thermo bonded and welded at each seam, said at least one bladder having at least one cell separator dividing said at least one bladder into at least two inflatable cells, said at least one bladder further having an inflation fitting for each cell;

At least one storage compartment for receiving said at least one bladder provided on said hull clear of the normal waterline of said boat, said at least one storage compartment having a front, a back and a length, said at least one storage compartment having a rubber sealed bladder release slot extending along the length and the front of said at least one compartment;

At least one fabric mounting strip mounted to the side of said at least one bladder, said at least one mounting strip having mounting holes with reinforcement grommets for receiving a fastener, said fastener securely mounting said at least one mounting strip and said at least one bladder within the at least one storage compartment at the back of said at least one storage compatment;

A pressurized cylinder containing compressed gas, said cylinder having an emergency inflation valve with a cord or handle for activation by an occupant of said boat, said cylinder further having a manual shut off valve and a pressure line;

At least one gas hose attached to each inflation fitting and an inflation hose connected to each gas hose and to said pressure line;

Wherein the boat safety float system is activated by an occupant in an emergency such that compressed gas passes through said pressure line, said gas hose, said inflation hose and said inflation fitting so as to expand said at least one bladder out of said at least one storage compartment along said hull forming at least one large round float on one side of said boat.

* * * * *